US005321891A

United States Patent [19]

Arad et al.

[11] Patent Number: 5,321,891

[45] Date of Patent: Jun. 21, 1994

[54] DRAWING DEVICE

[75] Inventors: Avi Arad, Westport, Conn.; Melvin Kennedy, Hampton Bays, N.Y.

[73] Assignee: The Ohio Art Company, Bryan, Ohio

[21] Appl. No.: 948,337

[22] Filed: Sep. 21, 1992

Related U.S. Application Data

[63] Continuation of Ser. No. 635,365, Dec. 28, 1990, abandoned.

[51] Int. Cl.[5] ..... B43L 13/00

[52] U.S. Cl. ..... 33/18.1; 33/23.11

[58] Field of Search ..... 33/18.1, 23.11, 1 M

[56] References Cited

U.S. PATENT DOCUMENTS

| | | | |
|---|---|---|---|
| 2,671,965 | 3/1954 | Pollitt | 33/18.3 |
| 4,459,602 | 7/1984 | Anderka et al. | 33/18.1 X |
| 4,550,503 | 11/1985 | Klawitter | 33/18.1 |
| 4,949,466 | 8/1990 | Auer et al. | 33/18.1 |

*Primary Examiner*—Thomas B. Will

*Attorney, Agent, or Firm*—McDermott, Will & Emery

[57] ABSTRACT

This invention relates to an apparatus for writing or drawing that is characterized by an enclosed case having a front side and a back side and in which the front side consists of a transparent screen. Disposed within a substantially rectangular case is a slightly adhesive powder which adheres to the undersurface of the transparent screen so as to render it opaque. A first and second stylus is mounted within the case for producing relatively thick and relatively thin lines by movement along the undersurface of the transparent screen in a manner for removing the adhesive powder and to thus produce lines. The first and second stylus are both moved in the X and Y coordinates through the use of external horizontal and vertical line control knobs which are internally coupled to the multiple stylus by first and second transverse rods, each being supported on and attached to a separate cable loop system. The multiple stylus may be fixedly withdrawn from the screen by actuation of the retraction thus enabling the operator to use both hands for moving the stylus to a second horizontal and/or vertical position on the screen without production of a line from the first to the second writing or drawing.

20 Claims, 3 Drawing Sheets

DRAWING DEVICE

This application is a continuation of application Ser. No. 07/635,365 filed Dec. 28, 1990 now abandoned.

BACKGROUND OF THE INVENTION

1. Field of the Invention:

This invention discloses a drawing and sketching device enabling one to draw a plurality of separate and distinct non-continuous sketches on a transparent screen rendered opaque by a slightly adhesive powder. The powder may be erased instantaneously by gentle shaking of the sketching device to thus enable re-use of the screen many times Lines or sketches are made on the screen through the use of a multiple stylus means mounted within the device and which are mechanically connected in the X and Y coordinates for movement to external line control knobs. A retraction means having a separate locking means enables the operator to create a plurality of separate and distinct non-continuous lines, words, or drawings on the screen while continuing to operate the external line control knobs. The device is shown to be substantially rectangular in overall configuration and is characterized by a substantially rectangular screen as dictated by the rectangular X and Y coordinate configuration of the stylus means.

2. Prior Art:

Drawing and sketching devices of this general type are well known.

Prior art include the Grandjean, Stubbman, Gresset and Aer et al. patents having registration numbers 3,055,113; 3,061,948; 4,135,303; and 4,856,197, respectively.

The Grandjean patent (U.S. Pat. No. 3,055,113) is an educational game comprising a closed casing with a transparent screen, packed with powdered material and a tracing mechanism with a tracing stylus of singular action.

The Stubbman patent (U.S. Pat. No. 3,061,948) creates a writing toy with engaging writing stylus in an enclosed casing with a "magic" pad which instantaneously erases the writing when the upper and lower members forming the pad are separated, and wherein the upper member is a translucent rigid member while the lower member is a pliable dark-colored opaque member. The latter is adhesively pressure sensitive and is juxtaposed under the upper rigid member. Markings are made on this pressure sensitive surface via a rolling ball stylus interconnected by a telekinetic linkage and a remote handle which is manipulated by pulling upward to make markings on the pad.

The Gresset patent (U.S. Pat. No. 4,135,303) contemplates a toy consisting of a box wherein a tracing stylus can create various indicia on the tracing screen previously coated with an opaque pulverulent powder. The device appears to be similar to the Grandjean patent with the exception that the stylus may be manipulated to skip lines.

The patent to Auer (U.S. Pat. No. 4,856,197) presents an apparatus again similar to the Gresset and Grandjean patents with respect to the stylus means. However, it differs in its provision for interrupting the lines drawn on the underside of the screen. The Auer patent teaches a mechanism to produce sketches and drawings having discrete elements. However, the manually operated interrupter mechanism requires constant manual depression by the operator, thus precluding free simultaneous use of both hands to manipulate the horizontal and vertical controls, that is, to continue the drawing effort.

Other prior art patents are referenced in the Auer patent (U.S. Pat. No. 4,856,197), all of which are incorporated herein.

SUMMARY OF THE INVENTION

The present invention is directed to a drawing device characterized by a movable multiple stylus means. As seen in prior art, devices of this type commonly have a plurality of line control means, namely, (a) the horizontal direction control means, and (2) the vertical direction control means; both of which must present convenient two handed access to a user. Manual operation of these line control means create various line drawings, words or sketches on a screen. The present device, however, includes certain improvements and advantages not heretofore known. One of these features and advantages consists of a variable or multiple thickness stylus means which enables the operator to create relatively thick and relatively thin lines upon the screen. The advantage of the invention provides for a thick and thin line stylus means in which one is telescopically received within the other so as to thereby enable utilization of a singular stylus mounting means and operating mechanism for controlling a multiple stylus means.

Another feature and advantage of the invention not known in the prior art resides in a retraction means for terminating contact of both the thin or thick stylus means with the internal transparent screen so as to thereby create separate and distinct lines, drawings or words.

Still another feature and advantage of the invention resides in a retraction means having a locking means for maintaining each of the thick or thin stylus means in a retracted position without continual operator control. The advantage of the invention resides in a locking means which is actuated by a single control knob means, accessible to one of the hands of the operator and with respect to which the operator may selectively have use of the thin stylus means, the thick stylus means, or the retraction of both, all with the same retraction and locking means. This enables the operator to continue to use both of his right and left hand at easily accessible, opposite positions at the bottom of the device, to preclude coverage of the screen during sketching to, in turn, enable movement of the stylus means to a subsequent position without simultaneously having to operate the retraction means itself.

These features and advantages of the invention will become more readily apparent upon a careful reading of the following Detailed Description, Claims and Drawings, wherein like numerals denote like parts in the several views.

DETAILED DESCRIPTION OF THE INVENTION

Figure 1:
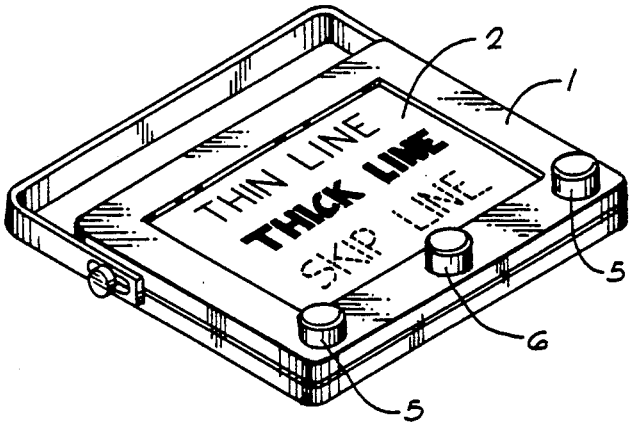
FIG. 1 shows, in perspective view the writing and sketching device in accordance with the invention.
Figure 2:
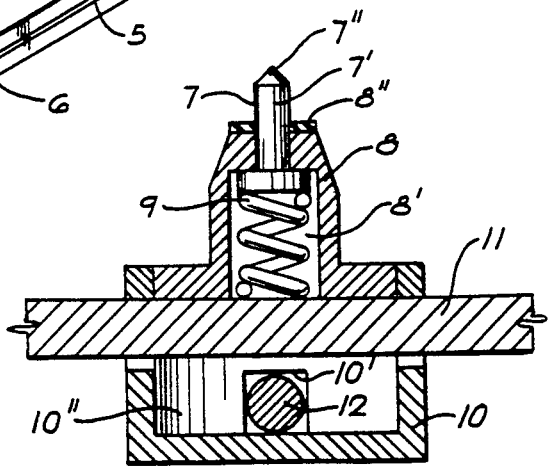
FIG. 2 illustrates in the plan view the bottom tray of the device and the cable loop systems for controlling the transverse rods upon which the thick and thin stylus means is mounted.
Figure 3:
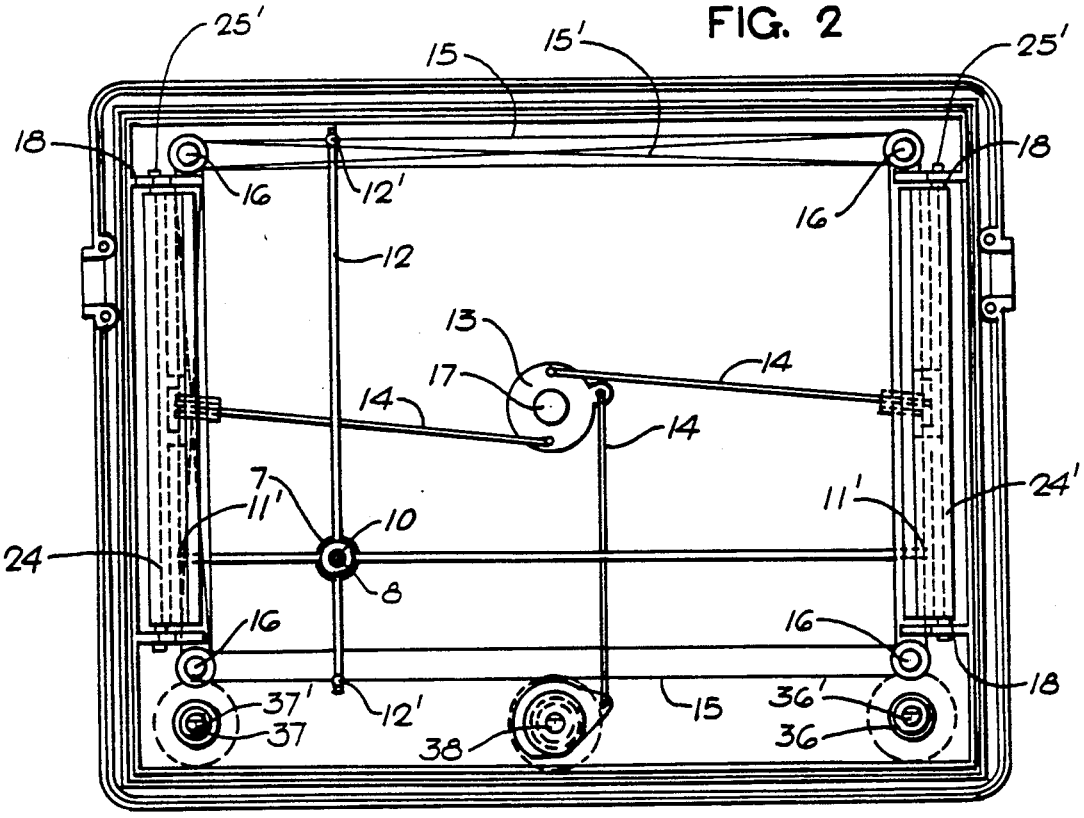
FIG. 3 shows a cross-sectional view of the multiple stylus means, its mounting means and the transverse rods.
Figure 4:
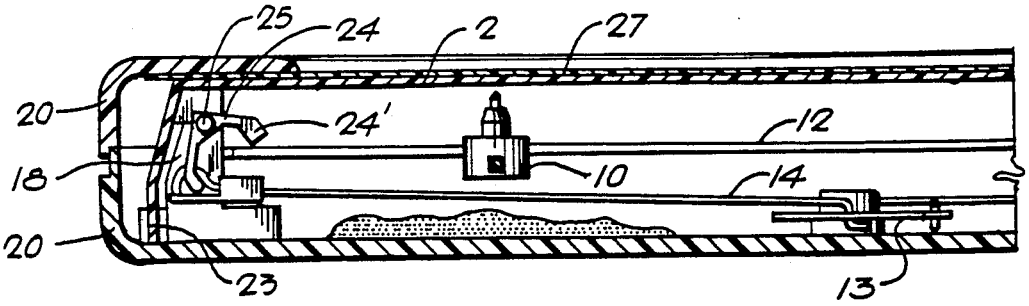
FIG. 4, 5 and 6 show a cross-sectional view of the bottom tray upon which the retraction means is mounted, including the three positions of the multiple stylus means.
Figure 5:
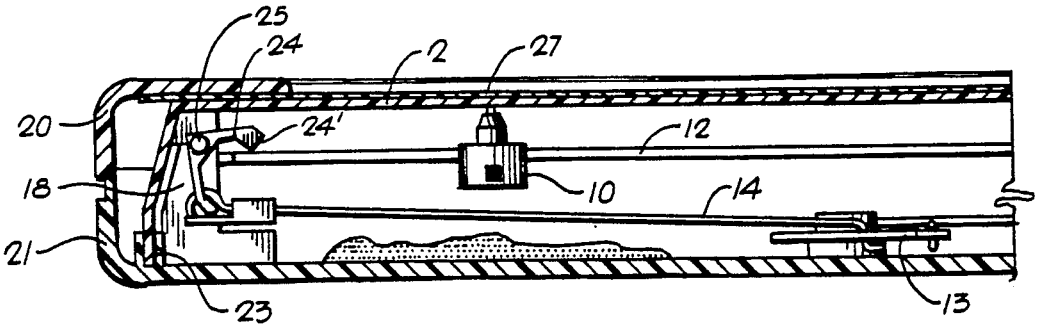
Figure 6:
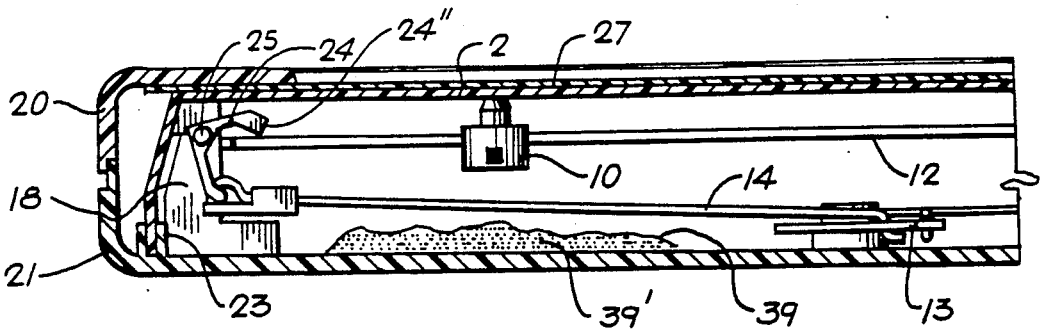
Figure 7:
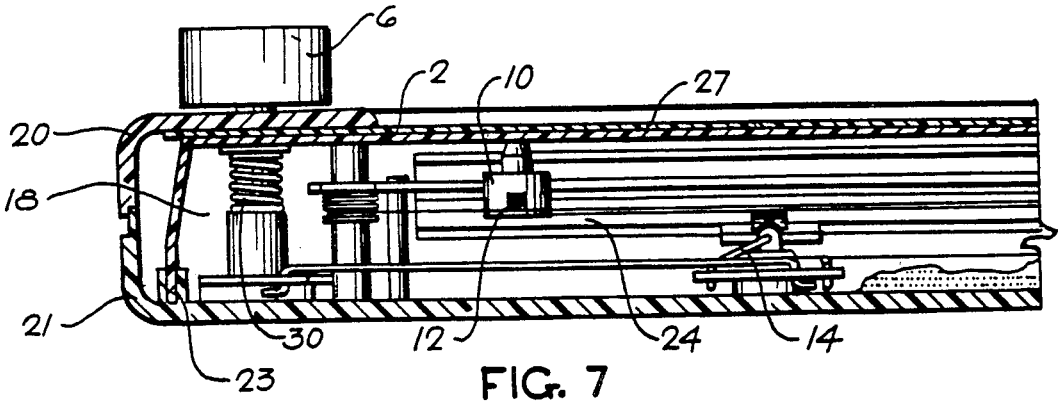
FIG. 7 shows a cross-sectional view of the association between the retraction means and the locking means.
Figure 8:
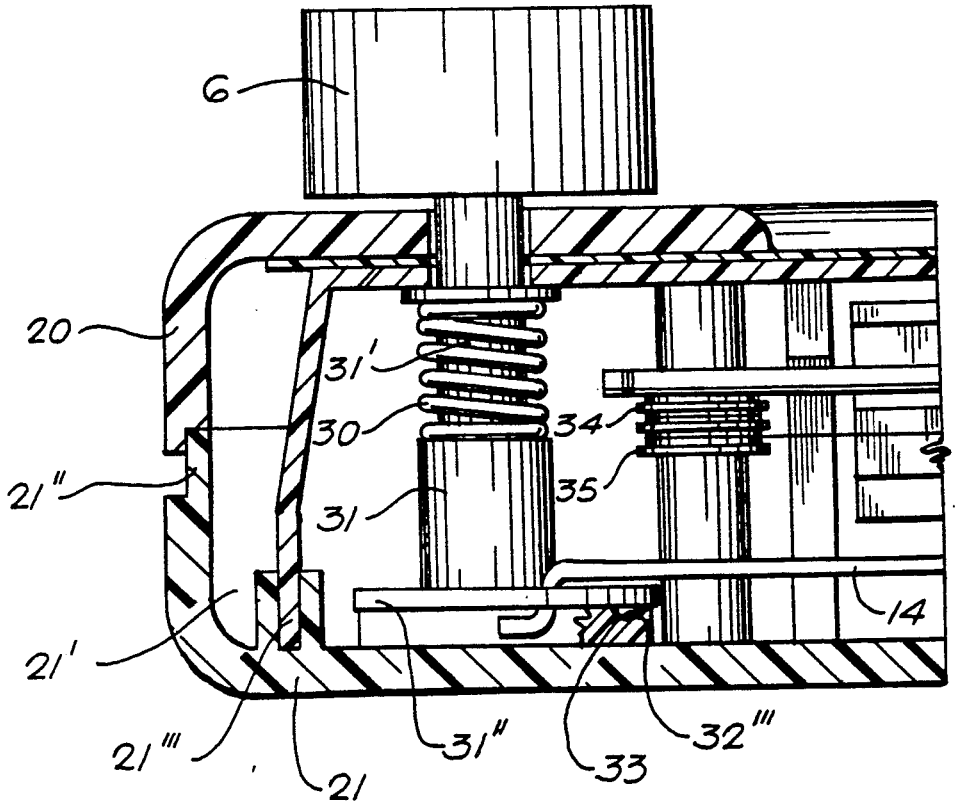
FIG. 8 illustrates a cross-sectional view of the control knob means including details of the bead and recess settings.
Figure 9:
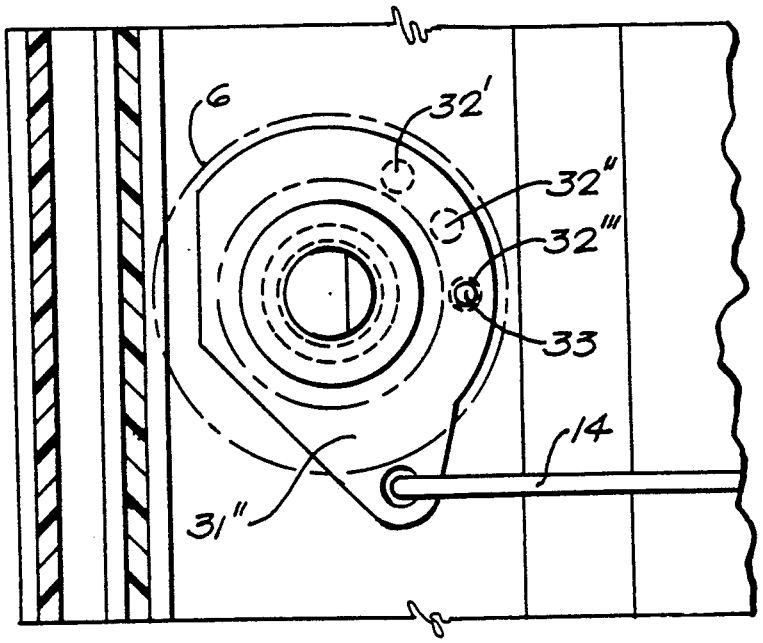
FIG. 9 illustrates the plane view of FIG. 8 of the control knob means including the three corresponding position settings for the retraction of the stylus means.

Referring generally to FIGS. 1 through 9, there is shown the drawing and sketching device in accordance with a preferred embodiment of the invention.

The sketching and drawing device comprises a bottom tray 21 molded, perhaps of plastic material, an internal transparent screen 2 also made of plastic material and a top casing 20 with a window $2^1$ exposing the internal transparent screen 2, also made of plastic material.

THE BOTTOM TRAY

The bottom tray 21 with flange edges $21^{11}$ meet the top casing 20 fitting tightly along the flange edges $21^{11}$ sealing the housing 1. Bottom tray 21 contains a groove 23 along the inside edges $21^1$ to accept the internal transparent screen 2, also formed in a tray shape with flange edges. Thus, the internal transparent screen 2 fits into the bottom tray groove 23 forming a tight seal, preventing leakage of the pulverulent material 39 described hereinafter. The top casing 20 further serves to seal the internal transparent screen 2 and the pulverulent material 39 contained therein, while covering the stylus movement mechanisms positioned therebelow. Bottom tray 21 is further molded with a plurality of posts 16 to accept these mechanisms including the various pulleys 34, 35, line control means 36, 37, central cam means 13, and other mechanisms for the operation of the drawing device described hereinafter.

THE INTERNAL TRANSPARENT SCREEN

The internal transparent screen 2 is characterized by flange edges $211^{11}$ molded to fit into the grooves 23 of the bottom tray 21 so as to form a tight seal.

THE TOP CASING

The top casing 20 may be characterized by three holes along one edge to accept two line control means 5 used for the multiple stylus means movement, and the control knob means for the retraction and locking means. The top casing 20 with a window $2^1$ exposing the internal transparent screen 2 is molded to fit over the bottom tray 21 forming a tight seal. The window $2^1$ of the top casing 20 is sealed by a transparent plastic material 27 attached along the inner window edges 26 of the top casing 20 forming a final seal between the internal transparent screen 2 and the top casing 20.

THE POWDER

The writing and sketching device 1 is partially filled with a pulverulent material 39 rendering the internal transparent screen 2 opaque and wherein minute ball bearings $39^1$ help coat the undersurface of the internal transparent screen 2 by enhancing movement of mass when the device is shaken about. The pulverulent material 39, such as powder, sand or the like, is slightly adhesive and may be made in various colors. This material, when coating the internal transparent screen 2, forms the writing surface upon which the first stylus 7 or second stylus 8 scrapes the lines made to write and/or sketch at the desired thickness.

THE TRANSVERSE RODS

Disposed within the device 1, also, are first and second transverse rods 11, 12 mounted on separate movable cable loop systems 15, $15^1$. The first and second transverse rods 11, 12 are moved horizontally and vertically, in the respective X and Y coordinate direction, with help of the cable loop systems 15, $15^1$. These rods are mounted perpendicular to each other through use of the stylus mounting means 10 which has a pair of perpendicular bores $10^1$ through which each transverse rod runs. The perpendicular arrangement of the rods again promotes utilization of rectangular casing and screen shapes. The stylus mounting means $10^1$ holds together the transverse rods 11, 12 at their intersection while the rods are attached at their ends $11^1$, $12^1$ to a corresponding cable loop system 15, $15^1$ described hereafter.

THE CABLE LOOP SYSTEM

Two rectangular cable loop systems 15, $15^1$ control movement of the multiple stylus means in the vertical and horizontal directions, each controlling one direction. The first cable loop 15 is looped in tension about one set of four pulleys 34 anchored at four pulley posts 16 on the bottom tray 21 forming a loop. The vertical transverse rod 12 is fastened at its ends along horizontal opposing loop sides $12^1$. A second cable loop $15^1$ is looped in tension about a second set of four pulleys 35 anchored just below the first set of pulleys 34 at the same four corner pulley posts 16 forming a second rectangular loop $15^1$ just below the first 15. The horizontal transverse rod 11 is fastened at its ends $11^1$ along the vertical opposing loop sides. Each cable loop 15, $15^1$ is coupled to a separate line control means 36 37 anchored at separate posts $36^1$, $37^1$ which control the movement of the respective cable loop and thereby each of the traverse rods connected to that loop. The direction of the movement of the loop is dependent on the direction of the line control means 36, 37, i.e., left line control means 37 turned clockwise moves vertical rod 12 to right while the right line control means 36 turned clockwise moves horizontal rod 11 upwards and both, conversely. The cable loops 15, $15^1$ may be made of various materials including but not limited to nylon fiber or similar wear like material which may be held in tension along the pulleys 34, 35 and the line control means 36, 37.

THE MULTIPLE STYLUS MEANS

The multiple stylus means comprises an outer thick stylus (first stylus) 8 and a telescopically retracted spring loaded thin stylus (second stylus) 7. Thus, there are two separate writing and drawing thicknesses available to the user to pursue a better and more creative writing and/or drawing. The thicker stylus 8 consists of an outer hollow cylinder $8^1$. The thin stylus is mounted on a coil spring 9 in compressed fashion within the hollow cylinder $8^1$. The inner thin stylus 7 consists of a solid cylindrical shaft $7^1$ with a cone shaped top $7^{11}$ forming the writing point. As stated, the thin stylus 7 is spring loaded 9 inside the outer hollow cylindrical thick stylus 8 so that, in its natural position, the thin stylus 7 remains exposed through the truncated cone top surface $8^{11}$ of the cylinder $8^{1}$. Thus, when the multiple stylus means is at maximum retraction from the undersurface of the internal transparent screen 2, the inner thin stylus 7 pops out through the outer hollow thick stylus 8 but does not trace a drawing line since the thin stylus 7 does not touch the internal writing screen 2. However, as the stylus mounting means 10 is brought closer to the internal transparent screen 2, the thin stylus 7 comes into contact therewith and is activated to create a thin writing line. As the multiple stylus means is further brought closer to the internal transparent screen 2, the inner thin stylus 7 is compressed and pushed down flush with the truncated cone top $8^{11}$ thereby forming a thick stylus 8 which is used to make a thick line.

STYLUS MOUNTING MEANS

The stylus mounting means 10 couples the transverse rods 11, 12 to the multiple stylus means and 8. The stylus mounting means 10 may be cylindrical in shape, though not necessary. The hollow cylinder $10^{11}$ shown is characterized by four bores $10^{1}$ disposed normal to one another and through which the transverse rods 11, 12 pass at right angles. The thick stylus 8 is pushed up through the hollow cylinder $10^{11}$ with a tight fit at one end of the cylinder and secured at the other end by the transverse rods 11, 12 passing immediately under the thick stylus 8.

THE RETRACTION MEANS AND LOCKING MEANS

The retraction means comprises a spring loaded control knob means; two opposing pivoting lever beams 24 and $24^{1}$, a central cam means 13, and cam rods 14. The actuation of the control knob means causes correlative movement of the cam means 13 which in turn causes pivotal movement of the lever beams 24, $24^{1}$, causing the transverse rod 11 upon which, the stylus means is mounted to be retracted. (See FIGS. 1, 4–8.)

The control knob means includes a control knob 6 that sits on a post $31^{1}$ molded on the bottom tray 21, and consists of a cylindrical hollow shaft 31 with a corresponding cam means $31^{11}$ molded at the shaft's bottom. The post $31^{1}$ is mounted within a spring 30 that rests between the control knob 6 in the hollow shaft 31. When the control knob means is set at the appropriate position $32^{1}$, $32^{11}$, $32^{111}$ it is locked into that position with the help of a bead 33 located on the undersurface of the corresponding cam means $31^{11}$ which is positioned above one of three corresponding recesses $32^{1}$, $32^{11}$, $32^{111}$ on the surface of the bottom tray 2? . The bead 33 fits into the corresponding recess $32^{1}$, $32^{11}$, $32^{111}$, which prevents further movement of the control knob means by mechanically locking the retraction means. The multiple stylus means may be set at a new position by lifting the control knob 6 and repositioning the bead 33 at a new recess $32^{1}$, $32^{11}$, $32^{111}$ for a corresponding new setting.

The central cam means 13 sits on a post 17 near the center of the bottom tray 21. The control knob means is linked to the central cam means 13 through the cam rod 14, and said central cam means 13 is linked to the two opposing-vertical-pivoting lever beams 24 and $24^{1}$ respectively pivot on pivot rods 25 and $25^{1}$ and, with two cam rods 14. The two lever beams 24 control the distance of retraction of the multiple stylus means from the internal transparent screen 2. Thus, when the control knob means is operated, the central cam means 13 actuates by pushing the cam rods 14, and thereby pushing the top leg $24^{11}$ of the pivoting lever beam 24 down, by pivoting on pivot rods 25 and $25^{1}$ retracting the horizontal transverse rod 11.

Each pivoting lever beam 24 is anchored at its end on two corresponding posts 18 extending from the bottom tray 21. The lever beams 24 are anchored at the top by corresponding top caps $18^{1}$ molded on the undersurface of the internal transparent screen 2. Each pivoting beam 24 is designed to make contact with the horizontal transverse rod 11 at a minimum coefficient of friction because of its sharp v-shaped contact point $24^{v}$.

Although a detailed embodiment of the present invention is disclosed herein, it is to be understood that the disclosed embodiment is merely exemplary of the invention which may be embodied in various forms Therefore, specific structural and functional details disclosed herein should not be interpreted as limiting, but merely as a basis for the claims that follow hereafter and which are deemed as representative for teaching one skilled in the art to variously employ the present invention and virtually any appropriately detailed structure.

What is claimed is:

1. An drawing device for producing lines on a screen which constitutes one surface of an enclosed housing having line producing means internally thereof, and wherein said line producing means comprises:

(a) a slightly adhesive powder within the housing which adheres to the undersurface of said screen so as to render it opaque and which powder can readily be dislodged from the surface and re-spread thereon by shaking the housing;

(b) first and second movable cable loop means mounted within the device;

(c) first and second transverse rods each separately mounted on a respective one of said movable cable loop means so as to be each moved upon correlative movement of each said cable loop means;

(d) a multiple, stylus means for selective engagement with the transparent screen having a first and second relatively movable stylus mounted for sliding movement on both said first and second transverse rods at the intersection thereof for drawing a line of variable thickness on said transparent screen;

(e) external cable control means connected to said cable loop means for moving said multiple stylus means in orthogonal directions; and (f) a retraction means mounted within the device and connected to said multiple stylus means for selectively using either said first and second stylus or withdrawing said multiple stylus means out of contact with said transparent screen to thereby terminate the continuum of the line being formed thereon.

2. The drawing device of claim 1 wherein said first stylus is hollow, within which said second stylus is movably mounted.

3. A drawing device for producing lines on a transparent screen which constitutes one surface of an enclosed housing having line producing means internally thereof, and wherein said line producing means comprising:

(a) a slightly adhesive powder within the housing which adheres to the undersurface of said transparent screen so as to render it opaque and which powder can readily be dislodged from the surface and re-spread thereon by shaking the housing;

(b) first and second movable cable loop means mounted within the device;

(c) first and second transverse rods each separately mounted on a respective one of said movable cable loop means so as to be each moved upon correlative movement of each said cable loop means;

(d) a stylus mounted for sliding movement on both said first and second transverse rods at the intersection thereof for engagement with said transparent screen wherein said stylus includes first and second stylus portions which are mounted for coaxial movement relative to one another;

(e) external cable control means mounted on the housing and connected to the cable loop means for moving said stylus in horizontal and vertical directions respectively;

(f) a retraction means for retracting said stylus from said transparent screen; and (g) a locking means for locking said stylus in a retracted position.

4. The drawing device of claim 3 wherein said locking means includes an external control knob and detent means for locking the stylus in a retracted position.

5. A drawing device comprising:

a closed housing having at least one translucent side forming a screen covered with an opaque pulverulent powder;

a pair of intersecting rods mounted for movement within the housing;

manually operable control means including first and second knobs connected to said rods for selectively moving the rods relative to one another;

a multiple, coaxial stylus means including at least two styli which are movable relative to one another and slidably supported by said rods at the intersection thereof between the rods and the screen for selectively contacting the surface of the screen whereby the stylus means is caused to move and dislodge powder therefrom as the intersection between the rods moves in response to operation of the control means; and selectively operable retraction means mounted on the frame and connected to said stylus means for selective engagement of one of the plurality of styli with the screen.

6. The drawing device of claim 5 wherein the manually operable control means includes a pair of cable loops each separately connected to a respective one of the rods and urging the rods toward the screen.

7. The drawing device of claim 6 wherein the cable loops are mounted for movement on a plurality of pulleys provided at positions near the periphery of the housing.

8. The drawing device of claim 6 wherein the selectively operable retraction means includes lever means for engagement with at least one of said rods to move the rods in a direction generally opposite the direction urged by said cable loops.

9. The drawing device of claim 8 wherein said lever means includes a pair of beams for engagement with one of the rods.

10. The drawing device of claim 8 wherein the selectively operable retraction means includes a manually operable control knob means connected to the lever means to permit selective movement of the stylus means away from the screen.

11. The drawing device of claim 10 wherein said at least two styli can be selectively placed in contact with the screen by operation of the retraction means.

12. A drawing device comprising:

a closed housing having a least one translucent side forming a screen covered with a opaque pulverulent powder;

a pair of intersecting rods mounted for movement within the housing;

manually operable control means including first and second knobs connected to said rods and a pair of cable loop means mounted on the housing, said cable loop means mounting said rods for selective movement relative to one another upon correlative movment of each said cable loop and urging the rods toward the screen;

a multiple coaxial stylus means including at least two coaxially mounted stylus elements, including a first outer stylus element for drawing a relatively thick line and an inner second stylus element for drawing a relatively thin line on the screen, and each of which can be selectively placed in contact with the screen, and wherein said stylus means is slidably supported by said rods at the intersection thereof between the rods in the screen whereby the stylus is caused to move and dislodge powder therefrom as the intersection between the rods moves in response to operation of the control means; and a selectively operable retraction means mounted on the frame and being connected to the stylus means including a lever means and a pair of beams for engagement with at least one of said rods to move the rods in a direction generally opposite the direct urged by said cable loops and a manually operable control means connected to the lever means to permit selective movement of the stylus means away from the screen.

13. The drawing device of claim 12 wherein the second stylus element is biased relative to the first stylus element toward the screen so that operation of the retraction means can selectively bring the first stylus element out of contact with the screen while the second stylus element remains in contact with the screen.

14. The drawing device of claim 13 wherein said selectively operable retraction means includes indexing means for maintaining the retraction means in a plurality of positions.

15. The drawing device of claim 14 wherein the indexing means includes at least two defined positions with only the second stylus in engagement with the screen and the first stylus in engagement with the screen.

16. The drawing device of claim 15 wherein the indexing means includes at least three positions with the first stylus element in engagement with the screen, the second stylus element in engagement with the screen, or the stylus means out of engagement with the screen.

17. The drawing device of claim 16 wherein the lever means includes a plurality of pivotal beams for engagement with the rod assembly to move the rods to a position away from the screen and maintain the rods at said position during movement of the stylus means.

18. The drawing device of claim 15 wherein the retraction means includes an external control knob connected by linkage to each of the pivotal beams of the lever means whereby the beams engage and move the rod assembly away from the screen in a direction opposite the direction urged by said cable loops.

19. The drawing device of claim 16 wherein the first stylus element is cylindrical stylus element for engagement with the screen to provide said relatively thick line on the screen and said second stylus element is an internally mounted cylindrical stylus element to provide said thin line on the screen wherein said second stylus is mounted on a spring coil within the hollow cylinder.

20. A drawing device for producing lines on a screen which constitutes one surface of an enclosed housing having line producing means internally thereof, and wherein said line producing means comprises:

(a) a slightly adhesive powder within the housing which adheres to the undersurface of said screen so as to render it opaque and which powder can readily be dislodged from the surface and re-spread thereon by shaking the housing;

(b) first and second movable cable loop means mounted within the device;

(c) first and second transverse rods each separately mounted on a respective one of said movable cable loop means so as to be each moved upon correlative movement of each said cable loop means;

(d) a multiple, coaxial stylus means for selective engagement with the transparent screen, having a first and second stylus, wherein the second stylus is different in thickness than said first stylus, said styli being mounted for sliding movement on both said first and second transverse rods at the intersection thereof for drawing and/or sketching a line of variable thickness on said transparent screen;

(e) external cable control means connected to said cable loop means for moving said multiple stylus means in orthogonal directions; and (f) a retraction means which comprises a control knob means connected to a central cam means, wherein said central cam means is mounted on said device and is connected to two opposing pivoting lever beams for simultaneous movement of said lever beams, wherein said control knob means selectively moves either said first or second stylus into a line marking position on said transparent screen, and for effectuating retraction of said multiple stylus means from the surface of the transparent screen to thereby terminate the continuum of the line being formed thereon.

* * * * *